US005746526A

United States Patent [19]

Hirose

[11] Patent Number: 5,746,526

[45] Date of Patent: May 5, 1998

[54] PRINTER APPARATUS FOR PRINTING ON BOTH SURFACES OF PAPER OR THE LIKE

[75] Inventor: Takashi Hirose, Tokyo, Japan

[73] Assignee: NEC Corporation, Tokyo, Japan

[21] Appl. No.: 716,537

[22] Filed: Sep. 19, 1996

[30] Foreign Application Priority Data

Sep. 21, 1995 [JP] Japan ..... 7-242689

[51] Int. Cl.[6] ..... B41J 11/26

[52] U.S. Cl. ..... 400/619; 347/16; 347/104; 101/490; 400/55

[58] Field of Search ..... 400/120.01, 611, 400/612, 619, 55; 101/490, 211; 347/104, 153, 218, 164, 262, 264

[56] References Cited

U.S. PATENT DOCUMENTS

| | | | |
|---|---|---|---|
| 4,591,884 | 5/1986 | Miyamoto et al. | 347/153 |
| 4,848,231 | 7/1989 | Stienstra | 101/490 |
| 5,297,018 | 3/1994 | Kashimura | 347/104 |
| 5,384,586 | 1/1995 | Hirano et al. | 347/104 |

FOREIGN PATENT DOCUMENTS

| | | |
|---|---|---|
| 0 534 337 | 3/1993 | European Pat. Off. . |
| 1-275082 | 11/1989 | Japan . |
| 2 279 301 | 1/1995 | United Kingdom . |

OTHER PUBLICATIONS

Patent Abstract of Japan, vol. 018, No. 513 (P-1805), 27 Sep. 1994 & JP-A-06 175434 (Kyocera Corp; Others:01), 24 Jun. 1994.

Patent Abstracts of Japan, vol. 014, No. 046 (M-0926), 26 Jan. 1990 & JP-A-01 275082 (Oki Electric Ind Co Ltd), 2 Nov. 1989.

Patent Abstracts of Japan, vol. 018, No. 502 (M-1676), 20 Sep. 1994 & JP-A-06 171158 (Tokyo Electric Co Ltd) 21 Jun. 1994.

Patent Abstracts of Japan, vol. 007, No. 265 (M-258), 25 Nov. 1983 & JP-A-58 145459 (Ricoh KK), 30 Aug. 1983.

*Primary Examiner*—Eugene H. Eickholt
*Attorney, Agent, or Firm*—Foley & Lardner

[57] ABSTRACT

A printing medium which has been fed from a hopper is transported along a transport path having a U-shape. The transport path is formed by first and second linear paths and a curved path. The printing medium is transported along each path in the order of the first linear path, the curved path and the second linear path. When the printing medium passes through the first linear path, the print head performs the printing onto a front surface of the printing medium. Thereafter, the printing medium reaches the second linear path through the curved path. When the printing medium passes through the second linear path, the print head performs the printing on a back surface of the printing medium. At the timing for transporting the printing medium along the curved path, the print head is moved from the vicinity of the first linear path to the second linear path. Thus, the print head is moved and set to be ready for printing in the two positions. The printing medium whose back surface has been subjected to the printing operation is stacked on a stacker.

20 Claims, 7 Drawing Sheets

PRINTER APPARATUS FOR PRINTING ON BOTH SURFACES OF PAPER OR THE LIKE

BACKGROUND OF THE INVENTION

1. Field of the Invention

The present invention relates to a printer apparatus for printing on both surfaces of paper or the like.

2. Description of the Related Art

A conventional printer apparatus for printing on both sided surfaces of paper or the like is disclosed in Japanese Patent Laid-Open Patent Publication No. Hei 1-275082.

Referring to FIG. 1, a piece of paper 100 which has been guided and fed by a paper guide 55 is subjected to printing by a print head 53, and thereafter is fed to a rear paper guide 57. The paper 100 fed to the rear paper guide 57 is deflected thereat and fed to a paper chute 59. In other words, the rear paper guide 57 serves as a so-called switch-back mechanism. The paper 100 which has been fed to a paper chute 59 is fed below a platen 65 and reaches a transport path switching member 63.

In the case where the printing is effected on both sides of the paper 100, the paper 100 which has reached the switching member 63 is again fed on the side of the print head 53 by the action of the switching member 63. On the other hand, in the case where the printing is effected only on one side of the paper 100, the paper which has reached the switching member 63 is transported on the side of a paper discharge guide 61 by the action of the switching member 63 and fed to the outside of the printer apparatus.

In the conventional printer apparatus, the switch-back mechanism is adopted as a mechanism for reversing the advancing direction of the paper 100. For this reason, the conventional printer apparatus requires a space having a length that is longer than that of the piece of paper as an extra space for causing the paper to stand by. Accordingly, due to this extra space, the overall size of the printer apparatus is unduly enlarged.

Furthermore, since the paper is transported below the platen, in case of the jamming of the paper, it would be difficult to remove the jammed paper.

Also, another conventional printer apparatus is disclosed in Japanese Laid-Open Patent Publication No. Hei 1-275082.

Referring to FIG. 2, in this conventional printer apparatus, a transport path is formed by a hairpin-like paper guide 78. Namely, the front surface of the paper is subjected to the printing operation while being passed through the lower portion of a print head 75, and thereafter is fed by the hairpin-like paper guide 78. When the paper is to be fed again through the lower portion of the print head 75, the paper is reversed to the back surface by passing through the hairpin-like paper guide 78. Accordingly, the back surface of the paper is subjected to the printing operation while passing through the lower portion of the print head 75.

In this conventional printer apparatus, when the front surface of the paper is subjected to the printing operation and when the back surface of the paper is subjected to the printing operation, the common transport path is used through the hairpin-like portion. Accordingly, the separator for separating the paper to be fed to the common transport path and the paper to be discharged from the transport path is required and causes the overall apparatus to be complicated. Also, since the common transport path is used for the paper feed and paper discharge, another piece of paper could not be fed until the paper to be discharged is discharged from the transport path. In addition, the jamming phenomenon is likely to occur.

SUMMARY OF THE INVENTION

It is an object of the present invention to provide a printer apparatus for printing both sided surfaces of a piece of paper or the like with a compact and simplified construction.

It is another object of the present invention is to provide a printer apparatus for printing both sided surfaces of a piece of paper or the like while preventing any jamming phenomenon.

In order to attain these and other objects of the present invention, according to the present invention, there is provided a printer apparatus comprising: a transport section, having a transport path including a first linear path, a second linear path and a curved path, for transporting a printing medium so that the printing medium passes through the first linear path, the curved path, and the second linear path, respectively, in this order; a print head for executing a first printing operation onto the printing medium when the printing medium passes through the first linear path, and a second printing operation onto the printing medium when the printing medium passes through the second linear path; and a first moving mechanism for moving the print head between the vicinity of the first linear path and the vicinity of the second linear path.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
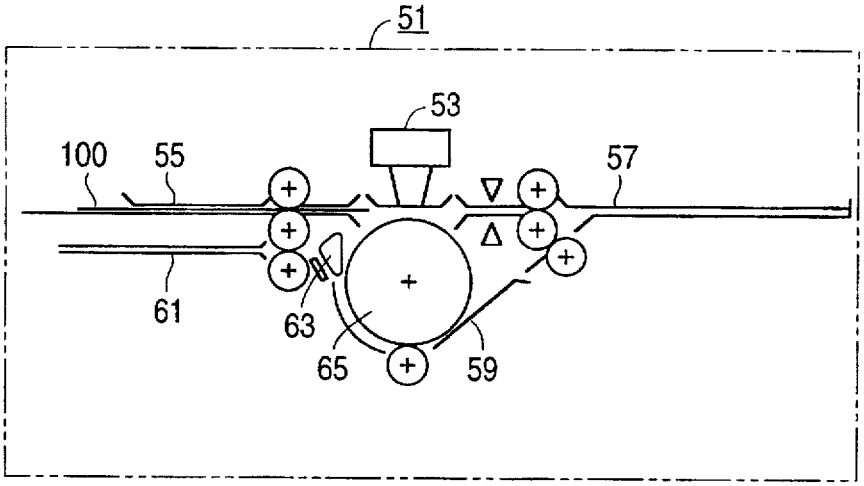
FIG. 1 PRIOR ART
FIG. 1 is a view showing a structure of a conventional printer apparatus.
Figure 2:
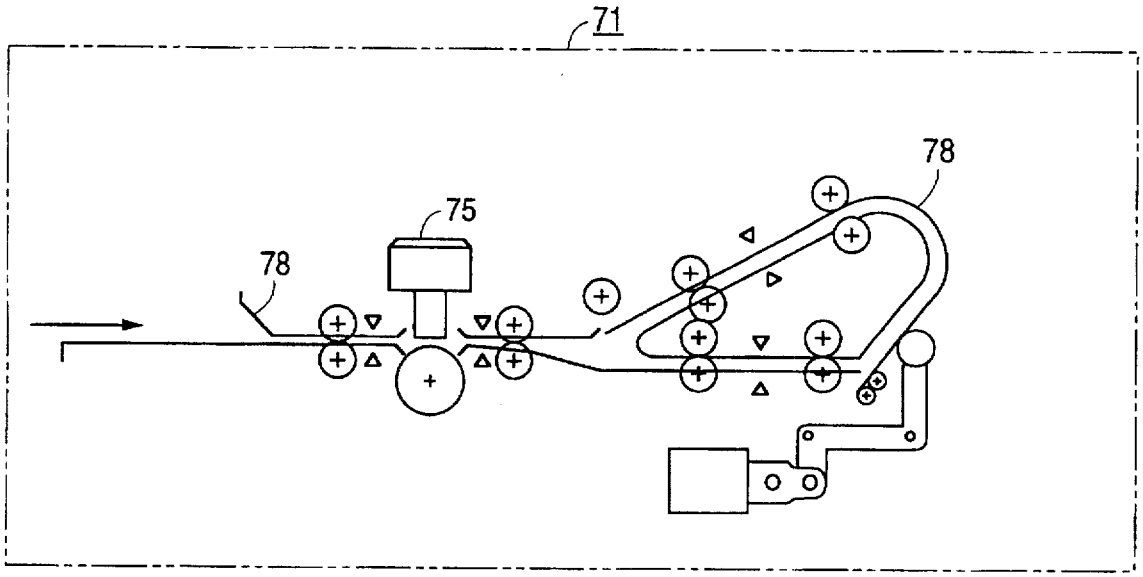
FIG. 2 PRIOR ART
FIG. 2 is a view showing a structure of an another conventional printer apparatus.
Figure 3:
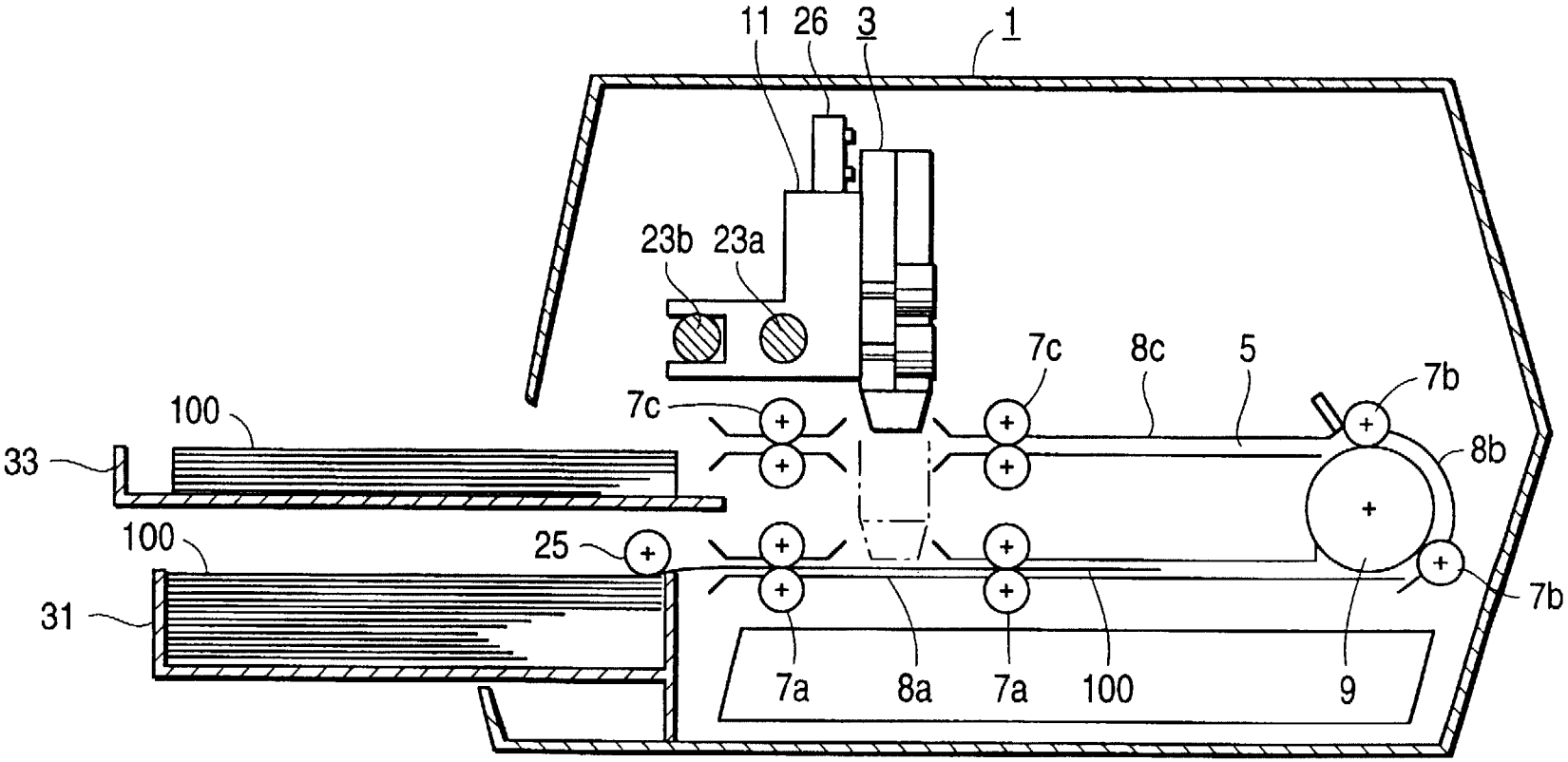
FIG. 3 is a view showing a printer apparatus in accordance with an embodiment of the present invention.

A preferred embodiment of the present invention will now be described in detail with reference to the accompanying drawings. Referring to FIG. 3, the printer apparatus according to the embodiment of the present invention is provided with a print head 3 for executing a printing operation to a piece of paper 100 or the like, a U-shaped transport path 5 along which the paper 100 is transported, and transport rollers 7a, 7b and 7c disposed in the vicinity of the U-shaped transport path 5 for transporting the paper 100. The transport path 5 comprises two linear paths arranged substantially in parallel each other and a curved path for connecting the two linear paths. The paper 100 is transported on the lower linear path, the curved path and the upper linear path in this order. The front surface of the paper 100 is printed at a lower printing position in which the paper 100 passes on the lower linear path and the back surface of the paper 100 is printed at a upper printing position in which the paper 100 passes on the upper linear path. A print head 3 is formed to be movably up and down and to be able to stop either in the vicinity of the upper and lower printing positions.

A so-called ink jet type print head which ejects ink from nozzles is used as the print head 3. Nozzle holes are formed at a tip end portion of the print head 3 for the ink ejection. However, the printer apparatus according to the present invention is not limited to the ink eject type one but may be of a dot impact type, for instance.

Figure 4:
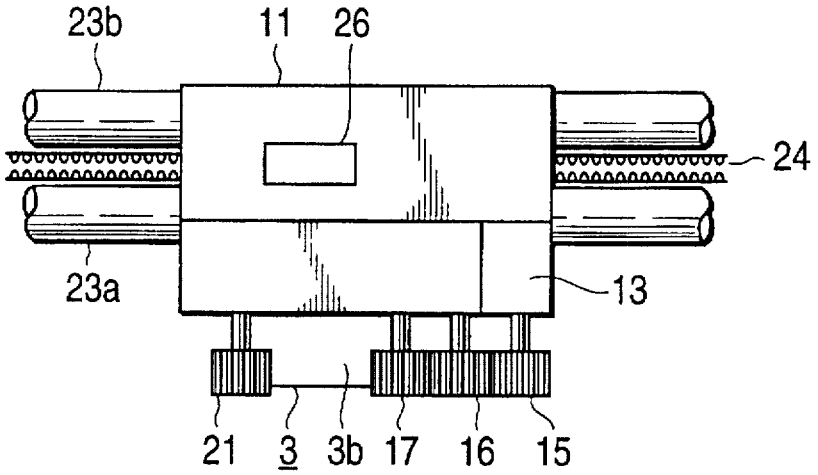
FIGS. 4 to 6 are views showing a print head, a mechanism for moving the print head in a vertical direction, and a mechanism for moving the print head in a horizontal direction in accordance with the embodiment of the present invention.
Figure 5:
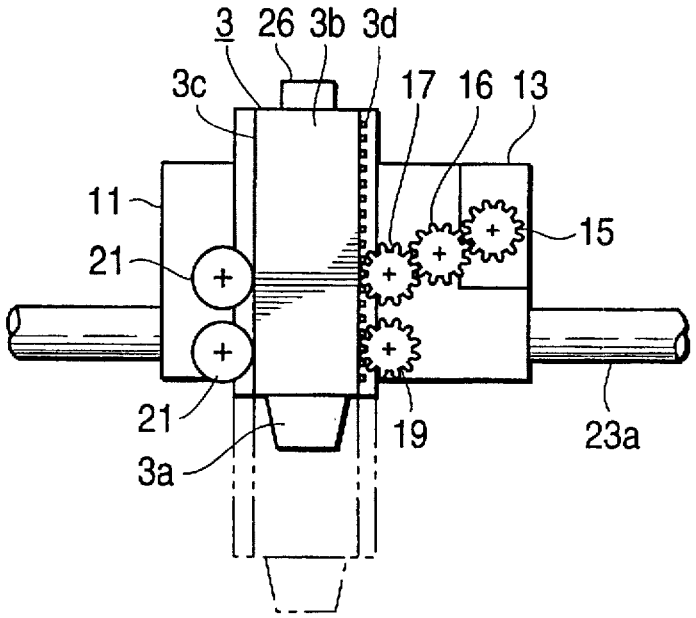
Figure 6:
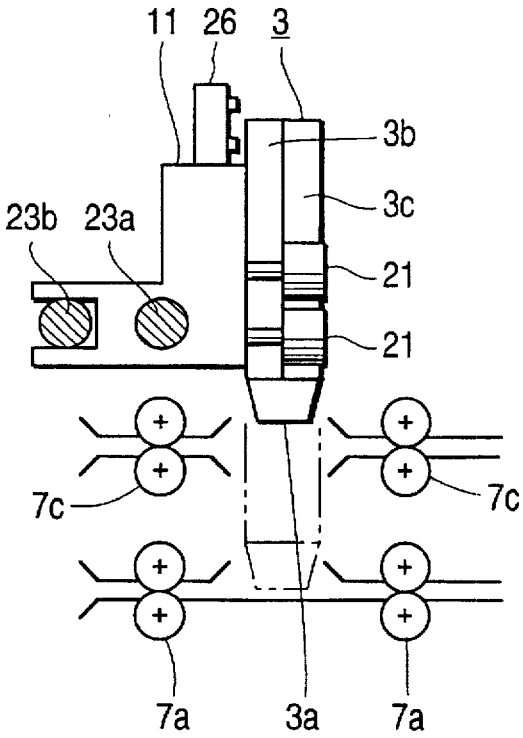

In the dot impact type printer apparatus, a ribbon cassette drive section or a platen are provided besides the structure shown in FIG. 3. In particular, the platen has to be movable in order not to prevent the print head from moving up and down. Referring to FIGS. 4, 5 and 6, the print head 3 comprises a substantially rectangular post-like print head body 3b, and a print head portion 3a arranged at the tip end portion of the print head body 3b. The print head 3 is supported by support rollers 21 and a pinion gear 17 on the side wall portions of a carrier 11. A pair of stepped portions 3c are formed at both opposite end sides of the surface of the print head body 3b. A rack 3d that engages with the pinion gear 17 is formed on one of the stepped portions 3c. Then, the pinion gear 17 and the support rollers 21 are in contact with the stepped portions 3c so that the print head 3 is supported on both sides.

A drive motor 13 is arranged on the surface of the carrier 11. The drive motor 13 is rotated through a desired rotational angle on the basis of a signal from a controller (not shown) and a stepping motor, for instance, is used as the drive motor 13. A motor gear 15 is mounted on a rotary shaft of the drive motor 13 and is rotated in response to the rotation of the motor 13. Transmission roller 16 is mounted in the vicinity of the motor gear 15 while engaging with the motor gear 15.

The transmission gear 16 engages also with the pinion gear 17 for transmission of the drive force of the motor 13 to the pinion gear 17. Also, as described above, the pinion gear 17 engages also with the rack 3d formed on the stepped portion of the print head 3. Accordingly, when the motor 13 is rotated, the driving force is transmitted through the motor gear 15, the transmission roller 16, and the pinion gear 17 to the print head body 3b so that the print head 3 is moved up and down. A driven gear 19 that operates in accordance with the movement of the rack 3d together with the movement of the up-and-down direction of the print head 3 is disposed below the pinion gear 17. The provision of the driven gear 19 may prevent the print head 3 from slanting.

On the other hand, the support rollers 21 for supporting the print head body 3b are arranged on the stepped portion 3c on the opposite side to the stepped portion 3c on which the pinion gear 17 is provided in the print head body 3b. The two support rollers 21 are provided in the vertical direction so as not to slant the print head 3.

A structure of the embodiment for precisely stopping the print head 3 in the vicinity of both of two upper and lower linear paths of the U-shaped transport path 5, that is, a position where the printing is effected on the front and back surfaces of the paper 100, will be explained with reference to FIG. 7.

Figure 7:
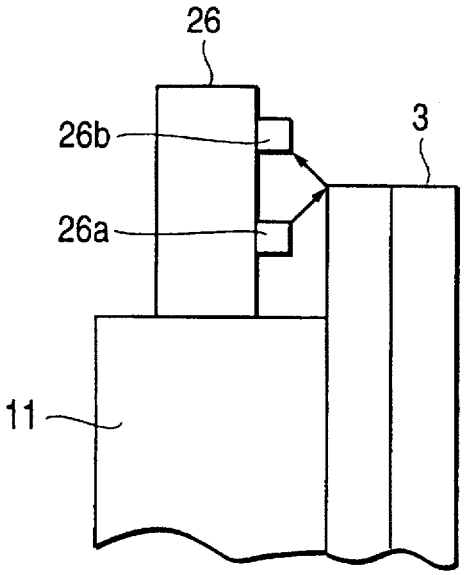
FIG. 7 is a view showing a structure for controlling stop positions of the print head according to the embodiment of the present invention.

Referring to FIG. 7, an optical sensor 26 is provided on the carrier 11 and comprises a light emitting portion 26a and a light receiving portion 26b. The light emitting portion 26a and the light receiving portion 26b are arranged so that a ray of light from the light emitting portion 26a may be detected by the light receiving portion 26b by reflecting at an edge portion of the print head 3 when the print head 3 is located at the upper printing position. Then, when the reflecting light is detected by the light receiving portion 26b, the drive of the drive motor 13 is stopped and the movement in the upward direction of the print head 3 is stopped. Accordingly, the print head 3 is accurately moved up to the upper printing position and set at that position.

Also, an interval between the upper printing position and the lower printing position is intrinsic to the apparatus and is set in advance. Furthermore, the amount of the vertical movement of the print head 3 may be controlled by utilizing the drive pulse number outputted from the drive motor 13. Accordingly, the print head 3 is accurately stopped at the lower printing position by controlling the amount of movement on the basis of the reference position of the upper printing position.

Thus, the print head 3 may be accurately stopped at the upper or lower printing position in response to the position where the printing paper 100 is transported.

Incidentally, the structure for moving the print head 3 in the vertical direction is not limited to that described above. For example, a moving mechanism which moves a support member up and down is provided within the body of the carrier 11 and the support member is projected to the front surface of the carrier 11 from the moving mechanism. Then, the print head 3 is mounted on the support member so that the print head 3 may be moved up and down in response to the operation of the moving mechanism. In the same way, the structure for controlling the stop position of the print head 3 is not limited to that described above but may be suitably designed in response to a structure for moving the print head 3 up and down.

Subsequently, a mechanism for moving the carrier 11 in the horizontal direction, i.e., in the direction in parallel with the paper 100 and in the direction perpendicular to the transporting direction of the paper 100 will now be described.

As shown in FIG. 6, the carrier 11 that carries the print head 3 thereon is formed in an L-shape in cross-section. Through-hole which passes through in the direction perpendicular to the moving direction of the print head 3 for setting the print head 3 at the printing position are formed in the carrier 11. A recess is formed at an end portion opposite to the portion of the carrier 11 where the print head 3 is mounted. The carrier 11 is engaged with guide shafts 23a and 23b fixed to the body of the printer apparatus 1, through the through-hole and the recess formed in the carrier 11. A predetermined gap is formed between the carrier 11 and the guide shafts 23a and 23b so that the carrier 11 may be smoothly moved relative to the guide shafts 23a and 23b.

Furthermore, a carrier belt 24 which is in parallel with the guide shafts 23a and 23b is coupled with the carrier 11. The belt 24 is used for moving the carrier 11 in the horizontal direction along the guide shafts 23a and 23b. The end portion of the belt 24 is connected to a stepping motor (not shown). The stepping motor is rotated on the basis of a signal from the controller (not shown). The rotation is transmitted to the carrier belt 24 and the carrier 11 is moved. With such an arrangement, the print head 3 may be moved in the widthwise direction of the paper 100, i.e., in the direction perpendicular to the transport direction of the paper 100. Accordingly, it is possible to effect the printing in the widthwise direction of the paper 100.

The printing operation with the print head 3 will now be described.

Figure 8A:
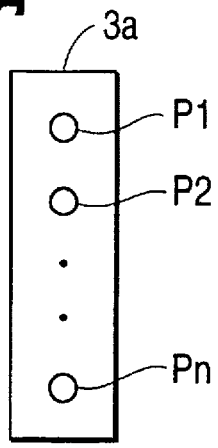
FIG. 8A is a view showing a structure of a front end face of the print head in accordance with the embodiment according to the present invention.
Figure 8B:
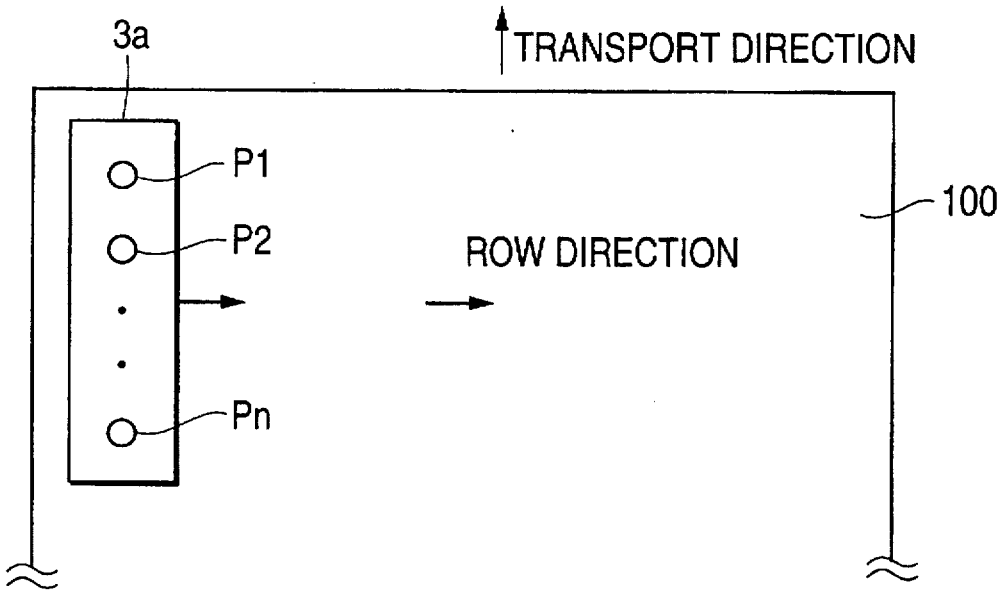
FIG. 8B is a view showing a printing operation of a printing medium by a print head.

Referring to FIG. 8A, a plurality of ink nozzles P1, P2, . . . , Pn are provided at the front end face of the print head portion 3*a*. Then, the ink is ejected to the paper 100 from the ink nozzles P1, P2, . . . , Pn on the basis of the printing data fed from a host computer (not shown). Also, as shown in FIG. 8B, the carrier 11 is moved horizontally in the direction perpendicular to the transport direction of the paper 100 so that the print head 3 is also moved horizontally to thereby effect the printing on the paper 100 in the row direction. The change of rows in printing operation is realized by the transport of the paper 100 corresponding to one line by the transport rollers 7*a* or 7*c*. Thus, the horizontal movement of the carrier 11, the transport movement of the paper 100 by the transport rollers 7*a* or 7*c*, and the ejection of ink of the ink nozzles P1, P2, . . . , Pn are controlled on the basis of the printing data to thereby effect the printing on the paper 100.

Also, in the case where the front surface of the paper 100 is subjected to the printing or in the case where the back surface of the paper 100 is subjected to the printing, it is necessary to convert the data representative of the moving direction of the print head 3, the ejection position of ink in the printing data, respectively. In the embodiment, the printing data from the host computer are identified into the specialized data for printing the front surface of the paper 100 and for printing the back surface of the paper 100 in advance and fed to the printer apparatus 1. However, it is possible to provide the circuit for converting the printing data in the printer apparatus 1. In this case, when the print head 3 is set at the upper printing position, the printing data from the host computer are converted in the printer apparatus, when the print head 3 is set at the lower printing position, the printing data are not converted.

The U-shaped transport path 5 will now be described.

Referring to FIG. 3, the U-shaped transport path 5 is composed of a first linear path connected to a hopper 31 for feeding the paper 100, a curved path for reversing the paper 100 and a second linear path connected to a stacker 33 to which the paper 100 is discharged. In this case, the transport path 5 is formed by paper guides 8*a*, 8*b* and 8*c* for clamping the paper 100, to be fed, from above and below. The paper guides 8*a*, 8*b* and 8*c* are formed of thin metal plates. The two of plates form a pair for defining each transport path 5. Also, the pairs of thin plates prevents the distortion of the paper 100 during the transport and are arranged at an optimum interval so that the paper 100 may be smoothly transported.

Almost all of the transport path 5 is continuously formed by the paper guides 8*a*, 8*b* and 8*c* but the transport path 5 is interrupted in the vicinity of the position where the print head portion 3*a* of the print head 3 is stopped. Namely, the transport path 5 is interrupted in the moving path of the print head 3 so as not to obstruct the vertical movement of the print head 3 in the second linear path. Furthermore, the transport path 5 is interrupted at the upper paper guide 8*a* in the printing position for the printing operation on the paper 100 by the print head 3 also in the first linear path. Incidentally, the paper guides 8*a*, 8*b* and 8*c* may be made not only of metal but also of resin such as plastic material.

Furthermore, a plurality of transport rollers 7*a*, 7*b* and 7*c* are arranged in the vicinity of the transport path 5. The transport rollers 7*a*, 7*b* and 7*c* are provided for transporting the paper 100 along the transport path 5 and two rollers of the upper and lower side are arranged for clamping the paper 100 on the transport path 5. The transport rollers 7*a* are arranged on both sides of the printing position in the first linear path of the transport path 5. The transport rollers 7*c* are arranged on both sides of the printing position in the second linear path of the transport path 5. The transport rollers 7*a* and 7*c* also serve to fix the printing paper 100 particularly in the case where the printing paper 100 is subjected to the printing operation.

On the other hand, a large size transport roller 9 having substantially the same radius of curvature as that of the curved path is disposed in the curved path of the transport path 5. A paper guide 8*b* is disposed at a predetermined interval outside of the transport roller 9. The curved path of the transport path 5 is formed of the transport roller 9 and the paper guide 8*b*. Also, the transport rollers 7*b* for transporting the paper 100 in the curved path are arranged in contact with the transport roller 9 outside of the transport roller 9.

Figure 9:
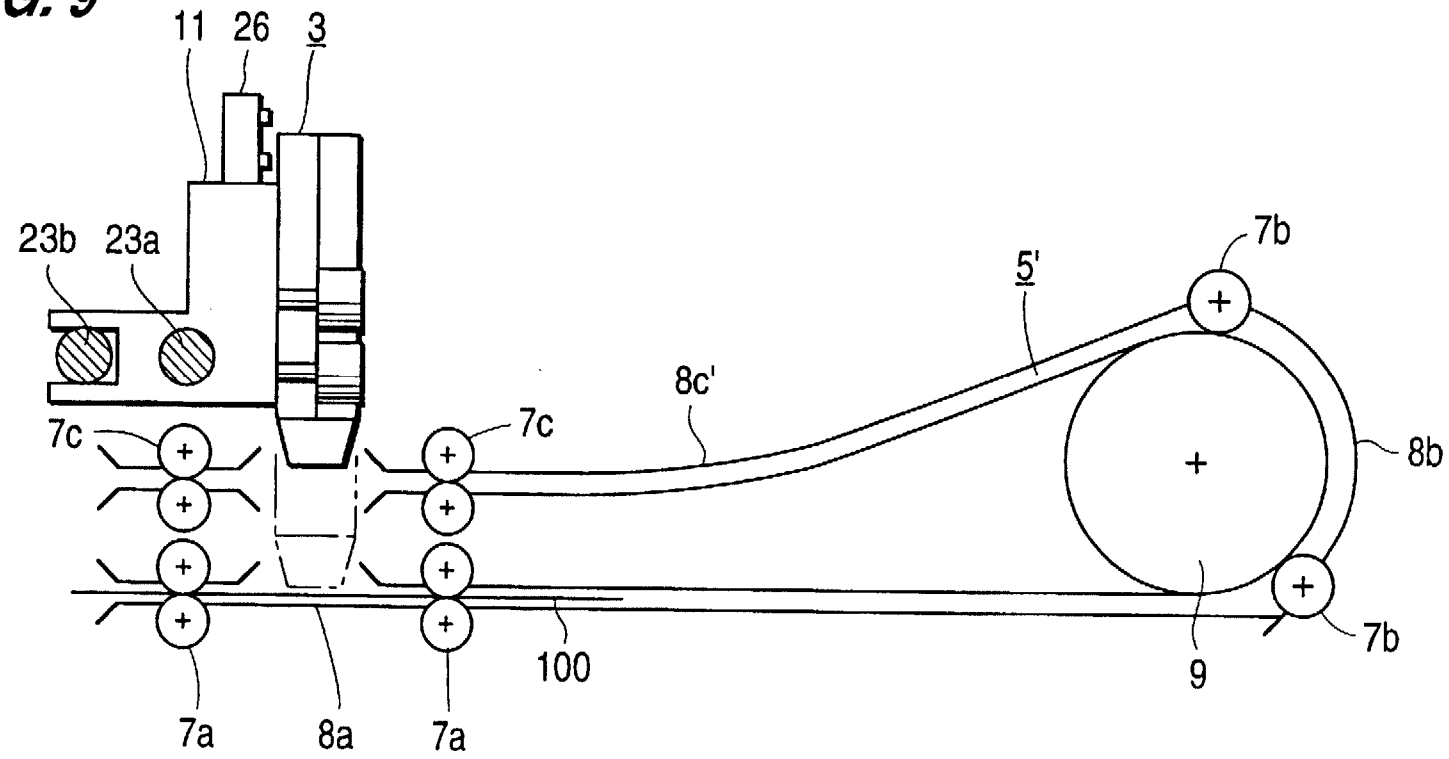
FIG. 9 is a view showing an another structure of the transport path of the embodiment of the present invention.

The transport path 5 has been explained. However, means for transporting the paper 100 is not limited to the structure described above. For example, the first linear path and the second linear path of the transport path 5 may be arranged closer to each other so that it is possible to use the hairpin-shaped transport path instead of the U-shaped transport path as the transport path 5 as shown in FIG. 9. With such an arrangement, it is possible not only to make the overall apparatus compact but also to make the moving mechanism for the print head 3 smaller or simpler since the moving distance of the print head 3 is shortened.

Subsequently, the operation of the printer apparatus according to the embodiment of the invention will now be described with reference to FIGS. 3 and FIGS. 10A to 10D.

Figures 10A, 10B, 10C, 10D:
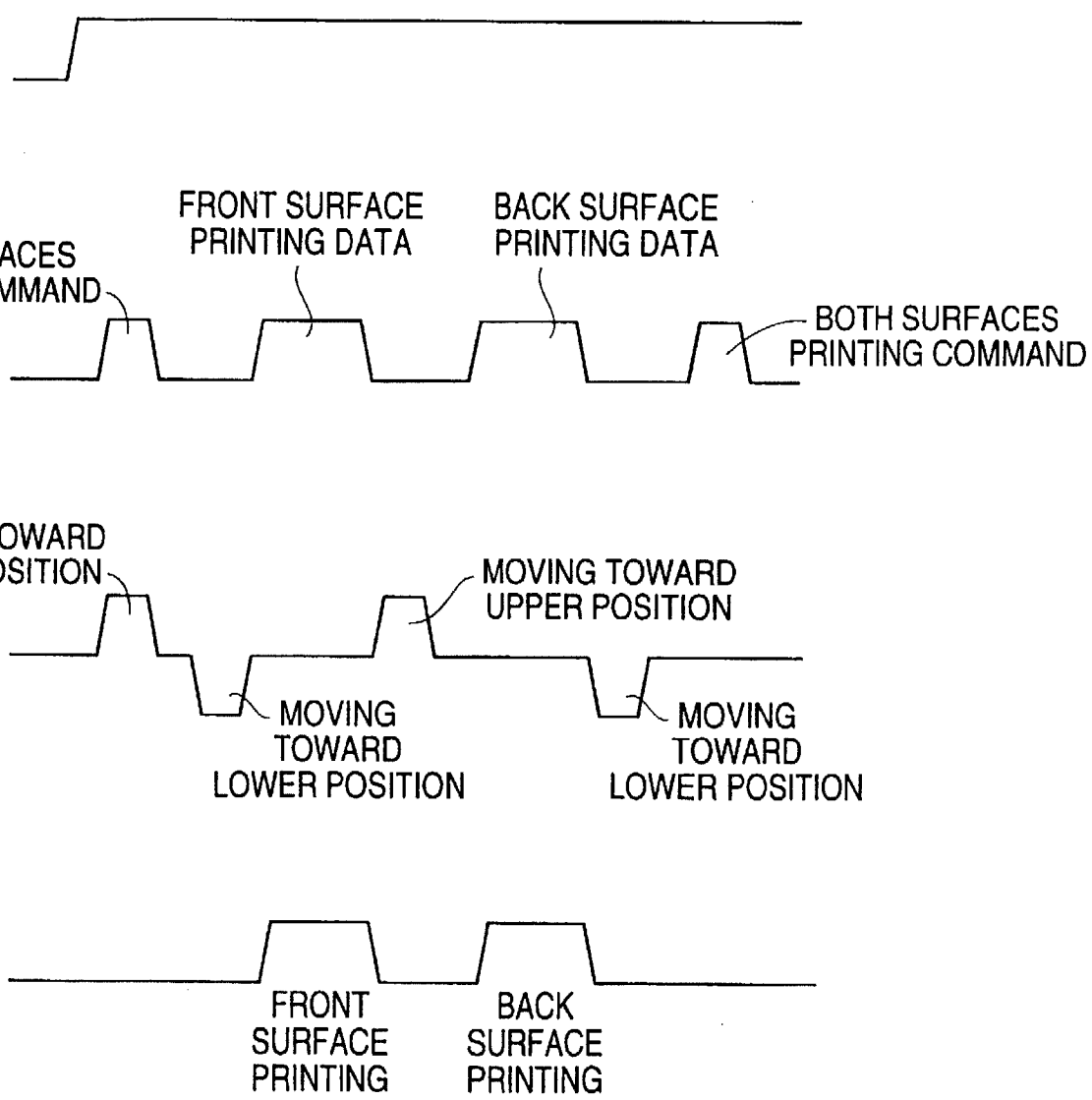
FIGS. 10A through 10D are timing charts showing the operation of the embodiment of the present invention.

When the power source of the printer apparatus 1 is turned on (FIG. 10A), after the paper 100 left on the transport path 5 has been discharged, the print head 3 is set at the upper printing position for setting a standard position for controlling the stop position of the print head 3 (FIG. 10C). When the printer apparatus 1 receives a data command for ordering the execution of the one-sided printing or a data command for ordering the execution of the both-sided printing from the host computer (not shown) (FIG. 10B), the print head 3 is moved down to the lower printing position (FIG. 10C).

Then, the pieces of paper 100 filled in the hopper 31 are fed one by one on the transport path 5 by the pickup rollers 25. The paper 100 which has been fed is caused to pass through the vicinity of the printing head 3 by the transport rollers 7*a*. In addition, the printing data are fed from the host computer (FIG. 10B). The printer apparatus 1 ejects the ink from the print head 3 to the front surface of the paper 100 which is passing through the vicinity of the print head 3, i.e., the paper 100 located at the lower printing position on the basis of the printing data fed from the host computer. Thus, the printing is executed onto the front surface of the paper 100 (FIG. 10D).

The paper 100 whose front surface has been subjected to the printing is transported to the curved path of the transport path 5, clamped by the transport roller 9 and the transport rollers 7*b* arranged along the curved path, and fed toward the second linear path of the transport path 5. The front and back surfaces of the paper 100 which has been fed to the second linear path of the transport path 5 have been reversed relative to the state where the paper has been transported along the first linear path. Simultaneously with such transport of the paper 100, the print head 3 is moved from the lower printing position to the upper printing position (FIG. 10C).

When the printing data for printing the back surface of the paper 100 are fed to the printer apparatus 1 from the host computer, the printer apparatus 1 ejects the ink to the back surface of the paper 100 from the print head 3 to thereby execute the printing operation onto the back surface (FIG. 10D). Thus, the printing operation is executed on both surfaces of the paper 100. The paper 100 whose back surface has been subjected to the printing operation is fed to the stacker 33.

When the printing operation onto the paper 100 in the upper printing position has been executed, the paper 100 which has been subjected to the printing operation is fed to the stacker 33 and at the same time the print head 3 starts to move to the lower printing position. Furthermore, at the timing of the completion of printing, a piece of new paper 100 starts to be fed from the hopper 31 to the transport path 5.

The above-described operation is repeated to thereby perform the printing operation on a plurality of pieces of paper in the hopper 31 with a high efficiency.

Incidentally, in the case where the printing data for the back surface of the paper 100 are not fed from the host computer, the paper 100 whose back surface has not been subjected to the printing operation by the print head 3 is caused to pass through the lower printing position and is stacked on the stacker 33.

As described above, in the printer apparatus according to the present invention, since the U-shaped or hairpin-shaped transport path is used as a mechanism for reversing the paper, it is possible to reduce the space needed for reversing the paper down to about half a size of the longitudinal length of the paper. Accordingly, it is possible to make the printer apparatus smaller in size.

Furthermore, the transport path used when the front surface of the paper is subjected to the printing operation and the transport path used when the back surface of the paper is subjected to the printing operation are made independent of each other. Accordingly, since it is unnecessary to reverse the transport directions of the paper on the transport path, the control steps may be simplified. Moreover, since the paper is always transported only in one direction along the transport path, the paper is always smoothly transported to prevent the generation of the paper jam phenomenon.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A printer apparatus comprising:

a transport section, having a transport path including a first linear path, a second linear path and a curved path, for transporting a printing medium so that the printing medium passes through said first linear path, said curved path and said second linear path, respectively, in this order;

a print head for executing a first printing operation onto the printing medium when the printing medium passes through said first linear path, and a second printing operation onto the printing medium when the printing medium passes through said second linear path; and a first moving mechanism for moving said print head between the vicinity of said first linear path and the vicinity of said second linear path.

2. The printer apparatus as claimed in claim 1, wherein said first linear path is arranged substantially in parallel with said second linear path.

3. The printer apparatus as claimed in claim 1, wherein a transport path including said first and second linear paths and said curved path is U-shaped.

4. The printer apparatus as claimed in claim 1, wherein a transport path including said first and second linear paths and said curved path is hairpin-shaped.

5. The printer apparatus as claimed in claim 1, wherein said transport section reverses a front surface and a back surface of the transported printing medium.

6. The printer apparatus as claimed in claim 1, wherein said print head executes said first printing operation on a first surface of the printing medium at a first position where the printing medium passes through said first linear path; and said print head executes said second printing operation on a second surface of the printing medium facing with said the first surface at a second position where the printing medium passes through said second linear path.

7. The printer apparatus as claimed in claim 1, wherein said first and second linear paths are formed by two guide plates for clamping the transported printing medium; and said curved path is formed by at least one guide roller and a curved guide plate arranged outside of said guide roller.

8. The printer apparatus as claimed in claim 1, wherein said transport section comprises first transport rollers and second transport rollers disposed, respectively, in said first and second linear paths, for clamping the printing medium from above and below and transporting the printing medium.

9. The printer apparatus as claimed in claim 7, wherein said transport section comprises a third transport roller in contact with said guide roller through the transported printing medium, for transporting the printing medium.

10. The printer apparatus as claimed in claim 8, wherein said first transport rollers are arranged on both sides of a first position where the first printing operation is executed by said print head.

11. The printer apparatus as claimed claim 10, wherein said second transport rollers are arranged on both sides of a second position where the second printing operation is executed by said print head.

12. The printer apparatus as claimed in claim 1, further comprising a second moving mechanism for moving said print head on said first and second paths in a direction perpendicular to the transport direction of the printing medium.

13. The printer apparatus as claimed in claim 1, wherein said print head comprises a plurality of nozzles for ink ejection at its front end face.

14. A printer apparatus comprising:

means for supplying a printing medium;

a first transport path for transporting the printing medium to a first position where a first surface of the printing medium is subjected to a first printing operation;

reverse means for reversing the first surface of the printing medium on which the first printing operation has been executed and a second surface facing with said first surface;

a second transport path for transporting the printing medium to a second position where a second surface of the printing medium is subjected to a second printing operation;

means for stacking the printing media whose second surfaces have been subjected to the second printing operation;

printing means for executing the first printing operation on the first surface and the second printing operation on the second surface; and moving means for moving said printing means from said first position to said second position.

15. The printer apparatus as claimed in claim 14, said first and second transport paths are substantially linear paths; and said first transport path is arranged substantially in parallel with said second transport path.

16. The printer apparatus as claimed in claim 14, wherein said reverse means transports the printing medium from said first transport path to said second transport path, and comprises a guide roller and a guide plate disposed outside said guide roller and having substantially the same radius of curvature as that of a curved surface of said roller.

17. The printer apparatus as claimed claim 14, wherein said first transport path is located below said second transport path and comprises a first upper guide plate and a first lower guide plate for clamping the printing medium which has been fed from said supply means, and at least one pair of first transport rollers for transporting the printing medium clamped by said first upper guide plate and said first lower guide plate.

18. The printer apparatus as claimed in claim 17, wherein said first upper guide plate is interrupted in the vicinity of said first position, and said first transport rollers are provided on both sides of the vicinity of said first position.

19. The printer apparatus as claimed in claim 14, wherein said second transport path is located above said first transport path and comprises a second upper guide plate and a second lower guide plate for clamping the printing medium which has been fed from said supply means, and at least one pair of second transport rollers for transporting the printing medium clamped by said second upper guide plate and said second lower guide plate.

20. The printer apparatus as claimed in claim 19, wherein said second upper guide plate is interrupted in the vicinity of said second position, and said second transport rollers are provided on both sides of the vicinity of said second position.

* * * * *